US011970867B2

(12) United States Patent
DeSanto

(10) Patent No.: US 11,970,867 B2
(45) Date of Patent: Apr. 30, 2024

(54) DOUBLE INSIDE CORNER SPACKLE TOOL

(71) Applicant: Andrew A. DeSanto, Southampton, NJ (US)

(72) Inventor: Andrew A. DeSanto, Southampton, NJ (US)

( * ) Notice: Subject to any disclaimer, the term of this patent is extended or adjusted under 35 U.S.C. 154(b) by 552 days.

(21) Appl. No.: 17/073,531

(22) Filed: Oct. 19, 2020

(65) Prior Publication Data

US 2021/0115683 A1 Apr. 22, 2021

Related U.S. Application Data

(60) Provisional application No. 62/924,003, filed on Oct. 21, 2019.

(51) Int. Cl.
*E04F 21/00* (2006.01)
*E04F 21/165* (2006.01)

(52) U.S. Cl.
CPC ..... *E04F 21/1655* (2013.01)

(58) Field of Classification Search
CPC ..... E04F 21/1655
See application file for complete search history.

(56) References Cited

U.S. PATENT DOCUMENTS 109,073 A * 11/1870 Streeter ..... E04F 21/16 404/97
397,129 A * 2/1889 Hill ..... E04F 21/06 15/235.5
398,781 A * 2/1889 Hovey ..... E04F 21/16 15/235.8
460,645 A * 10/1891 Maurer ..... E04F 21/16 15/235.7
761,242 A * 5/1904 Meyers ..... E04F 21/161 15/235.3
762,307 A * 6/1904 Hawksworth ..... E04F 21/06 15/235.4

(Continued)

FOREIGN PATENT DOCUMENTS

CA 2921443 A1 * 8/2016 ..... E04F 21/1652
DE 19713022 A1 * 10/1998 ..... E04F 21/163
EP 3617420 A1 * 3/2020 ..... E04F 21/1655

OTHER PUBLICATIONS https://www.plasterersforum.com/threads/three-sided-corner-trowel.32019/ (Year: 2010).*

(Continued)

*Primary Examiner* — Timothy Kennedy

(57) ABSTRACT

A spackling tool for spreading and smoothing spackling includes a main planar flat blade made of a thin resilient material. The blade is substantially rectangular in shape with left and right side edges and front and rear edges. In one embodiment, a left blade is formed by bending the material forming the main blade upwardly at an angle of substantially 90° and a right blade is formed in substantially the same way at the right side edge of the main blade. A handle is secured to the rear edge of the main blade at the midpoint thereof and extends away from the main blade in substantially the same plane as the main blade. In a second embodiment, the left and right blades are hinged to the main blade so that the angle between them and the main blade can be adjusted.

10 Claims, 2 Drawing Sheets

(56) References Cited

U.S. PATENT DOCUMENTS 855,633 A * 6/1907 Herring ..... E04F 21/32 425/458
867,819 A * 10/1907 Grundmann ..... E04F 21/165 15/235.3
952,971 A * 3/1910 Wolary et al. ..... E04F 21/161 15/235.8
1,019,399 A * 3/1912 Wright ..... B44D 3/162 279/94
1,348,639 A * 8/1920 Grundmann ..... E04F 21/161 15/235.3
1,370,060 A * 3/1921 Smith ..... E04F 21/1655 15/235.8
1,383,688 A * 7/1921 Word ..... E04F 21/1655 404/97
1,662,170 A * 3/1928 Sahlstrom ..... E04F 21/06 294/51
1,691,777 A * 11/1928 Mayes ..... E04F 21/161 15/235.4
2,008,952 A * 7/1935 Gach ..... E04D 15/04 15/245.1
2,081,735 A * 5/1937 Caronia ..... E04D 15/07 15/245.1
2,094,703 A * 10/1937 Hitzman ..... E04G 21/204 52/421
2,178,899 A * 11/1939 Shaffer ..... E04F 21/161 15/235.8
2,198,974 A * 4/1940 Pilant ..... E04F 21/06 15/235.4
2,278,803 A * 4/1942 Stabbert ..... E04F 21/06 15/235.4
2,339,235 A * 1/1944 Allen ..... E04F 21/1657 156/461
2,526,401 A * 10/1950 Oscar ..... E04F 21/06 15/235.8
2,608,853 A * 9/1952 Schrepper ..... E04F 21/00 15/235.8
2,701,465 A * 2/1955 Johnson ..... E04F 21/1655 15/235.7
2,745,129 A * 5/1956 Johnson ..... B29C 67/0044 15/245.1
2,806,240 A * 9/1957 Cottar ..... B27G 11/00 15/236.08
2,914,798 A * 12/1959 Lausman ..... E04F 21/32 425/458
3,095,594 A * 7/1963 Dornbos ..... E04F 21/06 15/235.4
3,105,262 A * 10/1963 Lathrop ..... B44C 7/08 15/235.7
3,146,481 A * 9/1964 Chiuchiarelli ..... E01C 19/44 403/85
3,391,509 A * 7/1968 Fruman ..... E04F 13/06 52/211
4,080,684 A * 3/1978 Venditti ..... E04F 21/06 15/245.1
4,631,019 A * 12/1986 House ..... B05C 17/10 15/245.1
4,757,572 A * 7/1988 Yon ..... E04F 21/1655 15/235.8
4,766,635 A * 8/1988 DeVitis ..... B28B 11/0809 15/235.4
4,779,301 A * 10/1988 Millette ..... E04G 23/006 30/169
4,915,610 A * 4/1990 Curry ..... E04F 21/06 15/235.4
4,919,604 A * 4/1990 Wilson ..... B26B 27/00 15/245.1
4,946,360 A * 8/1990 Brown ..... B05C 17/10 15/245.1
5,067,889 A * 11/1991 Humiston ..... E04F 21/1655 425/458
5,192,558 A * 3/1993 Sparrow ..... E04F 21/06 15/235.8
5,440,776 A * 8/1995 Kartler ..... B44D 3/105 15/245
5,442,832 A * 8/1995 Tonsager ..... E04F 21/161 15/235.8
5,467,497 A * 11/1995 Greene ..... E04F 21/1655 15/235.8
5,544,384 A * 8/1996 Forselius ..... E04F 21/163 15/235.8
5,664,280 A * 9/1997 Tonsager ..... E04F 21/1655 15/235.8
5,727,279 A * 3/1998 Pike, Jr. ..... E01C 19/44 404/97
5,737,795 A * 4/1998 Murders ..... E04F 21/244 404/97
D395,385 S * 6/1998 Pipic ..... D8/45
5,774,924 A * 7/1998 Beckham ..... E04F 21/161 15/235.8
5,792,489 A * 8/1998 Liberman ..... E04F 21/1655 425/458
6,308,370 B1 * 10/2001 Southby ..... E04F 21/20 15/236.08
6,379,080 B1 * 4/2002 Saffo, Sr. ..... E04F 21/244 15/235.4
6,595,764 B1 * 7/2003 Volk ..... E04F 21/00 15/235.8
6,880,198 B1 * 4/2005 Hazard ..... E04F 21/1655 15/235.7
7,144,193 B1 * 12/2006 Bousfield ..... E04F 21/163 404/97
D585,712 S * 2/2009 Lawrence ..... D8/45
7,647,668 B2 * 1/2010 Meyerl ..... E04F 21/1652 15/245.1
D625,976 S * 10/2010 Whiteside ..... D8/45
7,930,991 B2 * 4/2011 Northrup ..... B05C 11/041 118/100
D666,467 S * 9/2012 Salotto ..... D8/45
8,528,152 B1 * 9/2013 Hogan ..... E04F 21/162 15/235.4
8,528,153 B1 * 9/2013 Hogan ..... E04F 21/16 15/235.4
9,140,021 B2 * 9/2015 Ljungstrom ..... E04F 21/023
D809,233 S * 1/2018 Opry ..... D32/35
10,240,345 B2 * 3/2019 Kelly ..... E04D 15/00
D1,000,925 S * 10/2023 Juarez ..... D8/45
2008/0216738 A1 * 9/2008 Monroe ..... E04F 21/1652 118/200
2008/0295435 A1 * 12/2008 Uva ..... E04F 21/02 52/514
2009/0031518 A1 * 2/2009 Salvino ..... E04F 21/1652 15/235.7
2009/0083928 A1 * 4/2009 Salvino ..... E04F 21/1652 52/741.41
2009/0113647 A1 * 5/2009 Barstad ..... A46B 9/005 15/105
2009/0277380 A1 * 11/2009 Schmidt ..... B28B 19/0046 118/305
2009/0282635 A1 * 11/2009 Hoffman ..... E04F 21/161 15/235.8
2009/0288265 A1 * 11/2009 Wolan ..... E04G 21/201 15/235.4
2011/0041277 A1 * 2/2011 Giannantonio ..... E04F 21/1655 15/245.1
2014/0115804 A1 * 5/2014 Propst ..... E04F 21/162 15/235.4
2015/0275529 A1 * 10/2015 Morley ..... E04F 21/1655 83/880
2015/0354236 A1 * 12/2015 Andrews ..... E04F 21/1652 15/235.4
2019/0271166 A1 * 9/2019 Rogers ..... E04F 21/1652

OTHER PUBLICATIONS http://carobyn.com/tr_product_detail.asp?productID=115 (Year: 2010).*

* cited by examiner

DOUBLE INSIDE CORNER SPACKLE TOOL

CROSS-REFERENCE TO RELATED APPLICATION

The present application claims the benefit of prior provisional application Ser. No. 62/924,003, filed Oct. 21, 2019.

FIELD OF THE INVENTION

The present invention is directed toward a spackling tool for applying and smoothing spackling material or mud on drywall. The tool is capable of smoothing spackling on a wall or ceiling or substantially any planar surface and also to a right or left inside corner.

BACKGROUND OF THE INVENTION

During the building or repair of buildings and other physical structures, various viscous materials are used to fill and/or seal cracks and gaps in and between structural elements such as walls and ceilings and the like. The most common of these procedures is the finishing of drywall or sheet rock on both planar surfaces and corners. This is done with viscous materials such as spackle or joint compound, sometimes referred to as "mud."

Numerous tools have been developed to apply the various viscous materials to drywall and the like. One class of such tools are generally referred to as spreading tools which consist of one or more blade edges that are laid relatively flat against a surface and pulled downward spreading the viscous material. Traditionally, separate tools are needed for applying material along a flat surface and for applying material to an inside corner. Conventional flat surface tools are well known and consist essentially of an elongated flat metal or plastic blade with a handle attached centrally to one of the elongated side edges and extending outwardly in essentially the same plane as the blade.

Conventional inside corner tools have two flat blades formed at 90° to each other and do not uniformly distribute pressure exerted by the user. The tool must be laid flat against the corner, pushed in, and pulled down. As a result of this non-uniform pressure distribution, the corner drywall tape gets caught on the bottom of the tool. The snagging begins pulling and dragging the tape off the wall. Often the user must go back and readjust the tape and start all over again. Furthermore, in most conventional corner tools the handle is positioned in line with the corner. As a result, the tool cannot be used for spreading or smoothing spackle on a single planar surface.

The invention shown in U.S. Pat. No. 8,151,405 solves some of the problems of the prior art. The drywall trowel shown therein includes a first wide blade made of a sheet of resilient metal or plastic material having an inner face and an outer face. One side of the blade is bent at about 90° away from the plane of the blade to form a V-shaped point. A handle extends from a rear edge of the blade away from the bend line and lies in essentially the same plane as the blade.

As a result of the arrangement shown in the cited patent, the main wider blade is capable of spreading and smoothing spackle on a flat surface and the V-shaped point with both the main blade and the side blade is capable of finishing an inside corner. The major problem with the tool, however, is that it is either right handed or left handed. That is, the tool is designed to finish a right corner relative to where a worker is working or a left corner. It cannot do both. In many situations, therefore, the worker must carry two tools; one to finish a right corner relative to where the worker is working and one to finish a left corner.

There is, therefore, a need for a spackling tool that is capable of finishing a flat wall and a corner that is right of the wall and a corner that is left of the wall without making any changes to the tool.

SUMMARY OF THE INVENTION

The present invention is designed to overcome the deficiencies of the prior art discussed above. It is an object of the present invention to provide a spackling tool that is easy and convenient to use.

It is another object of the present invention to provide such a tool that is capable of finishing a flat wall and a corner that is to the right of the wall and a corner that is left of the wall without making any changes to the tool.

It is a still further object of the present invention to provide such a tool that allows for adjusting the tool so that it can be used to finish inside corners of various angles.

In accordance with the illustrative embodiments, demonstrating features and advantages of the present invention, there is provided a spackling tool for spreading and smoothing spackling that includes a main planar flat blade made of a thin resilient material. The blade is substantially rectangular in shape with left and right side edges and front and rear edges. In one embodiment, a left blade is formed by bending the material forming the main blade upwardly at an angle of substantially 90° and a right blade is formed in substantially the same way at the right side edge of the main blade. A handle is secured to the rear edge of the main blade at the midpoint thereof and extends away from the main blade in substantially the same plane as the main blade. In a second embodiment, the left and right blades are hinged to the main blade so that the angle between them and the main blade can be adjusted.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

All of the drawings, as shown and described above, illustrate the present invention both prior to and as used during spackling or similar use.

DETAILED DESCRIPTION OF THE PREFERRED EMBODIMENTS

Figure 1:
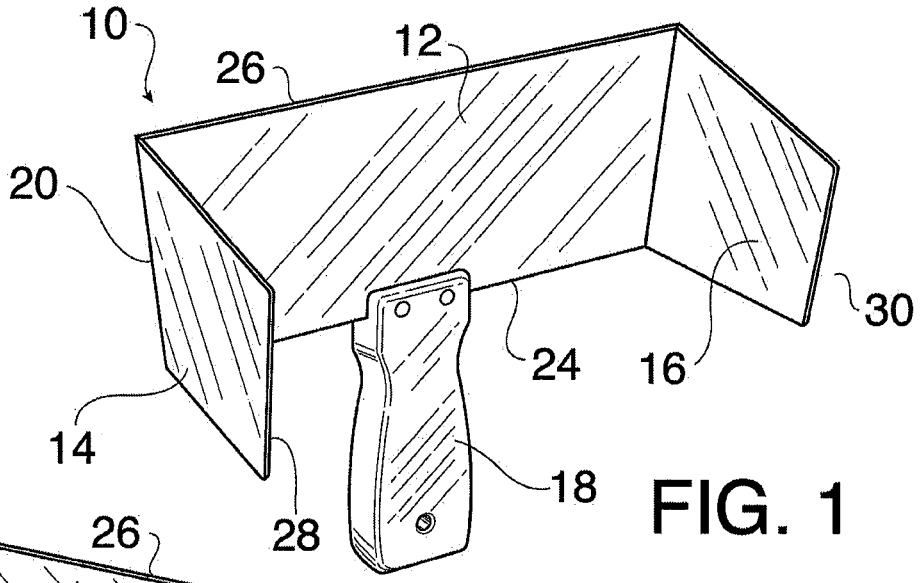
FIG. 1 is a left front perspective view of a first embodiment of the three sided spackling tool of my invention.
Figure 2:
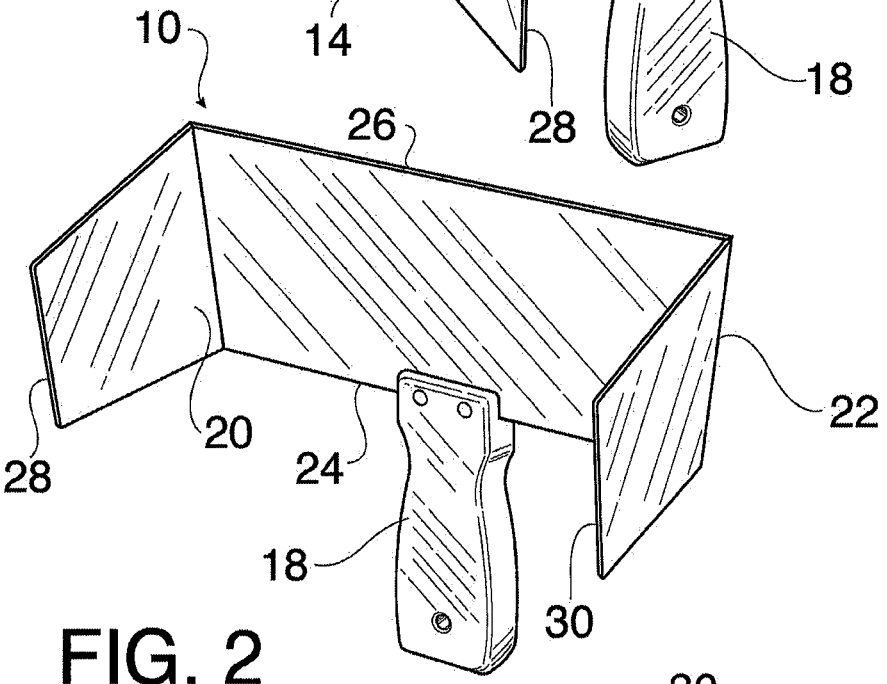
FIG. 2 is a right front perspective view thereof.
Figure 3:
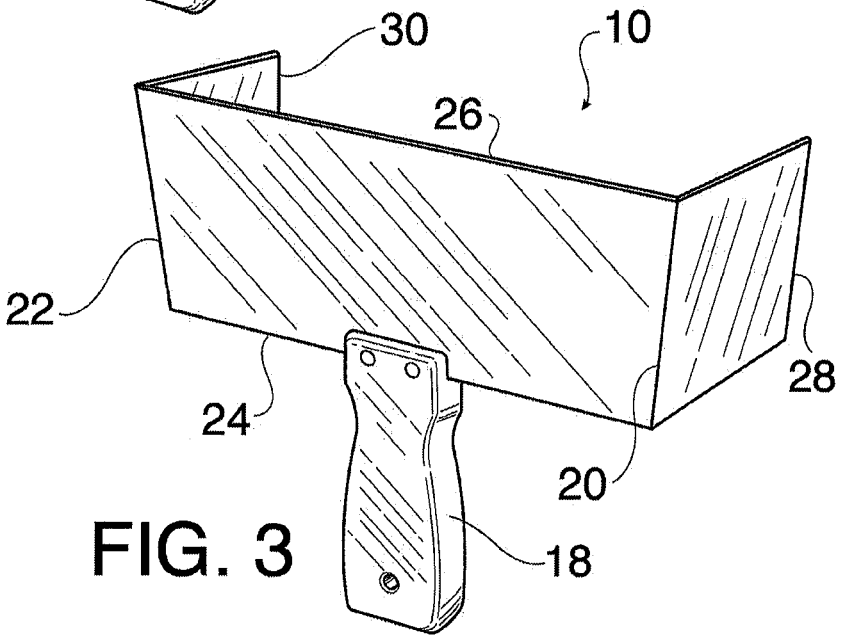
FIG. 3 is a rear perspective view thereof.

Referring now to the drawings in detail wherein like reference numerals have been used throughout the various figures to designate like elements, there is shown in FIGS. 1-3 a spackling tool constructed in accordance with the principles of the present invention and designated generally as 10. The tool 10 is comprised essentially of four main parts: a main blade 12, a left blade 14, a right blade 16 and a handle 18.

Preferably, the main blade 12, left blade 14 and right blade 16 are made from a single flat sheet of thin resilient material that is bent to form the three blades. The left and right blades 14 and 16 are bent at about 90° upwardly defining the left and right side edges 20 and 22 of the main blade 12. Although the dimensions may vary, it is preferred that the main blade 12, which lies in a single plane, be approximately 6 to 12 inches wide (from left to right in the figures) and 4 to 6 inches tall between the bottom edge 24 and the top edge 26. The top edge 26 is slightly longer than the bottom edge 24. The left blade 14 and right blade 16 are smaller than the main blade 12 having a dimension of about 4 to 6 inches from the side edges 20 and 22 to the ends 28 and 30.

The blades 12, 14, and 16 can be made from any thin resilient material normally used for spackling tools and the like. This includes various sheet metals and plastics; all of which are well known in the art.

The handle 18 is attached to the main blade 12 adjacent the bottom edge 24 and is located essentially midway between the left side edge 20 and the right side edge 22. As shown in the figures, the handle 18 lies in essentially the same plane as the main blade 12. By holding the handle 18, a worker can use the main blade 12 to apply and/or spread spackle onto a wall. Similarly, the tool can be used to finish an inside corner in the manner, for example, as shown in U.S. Pat. No. 8,151,405. Unlike the tool shown in that patent, however, the present tool can be used to finish an inside corner to the left or right of a workman.

Figure 4:
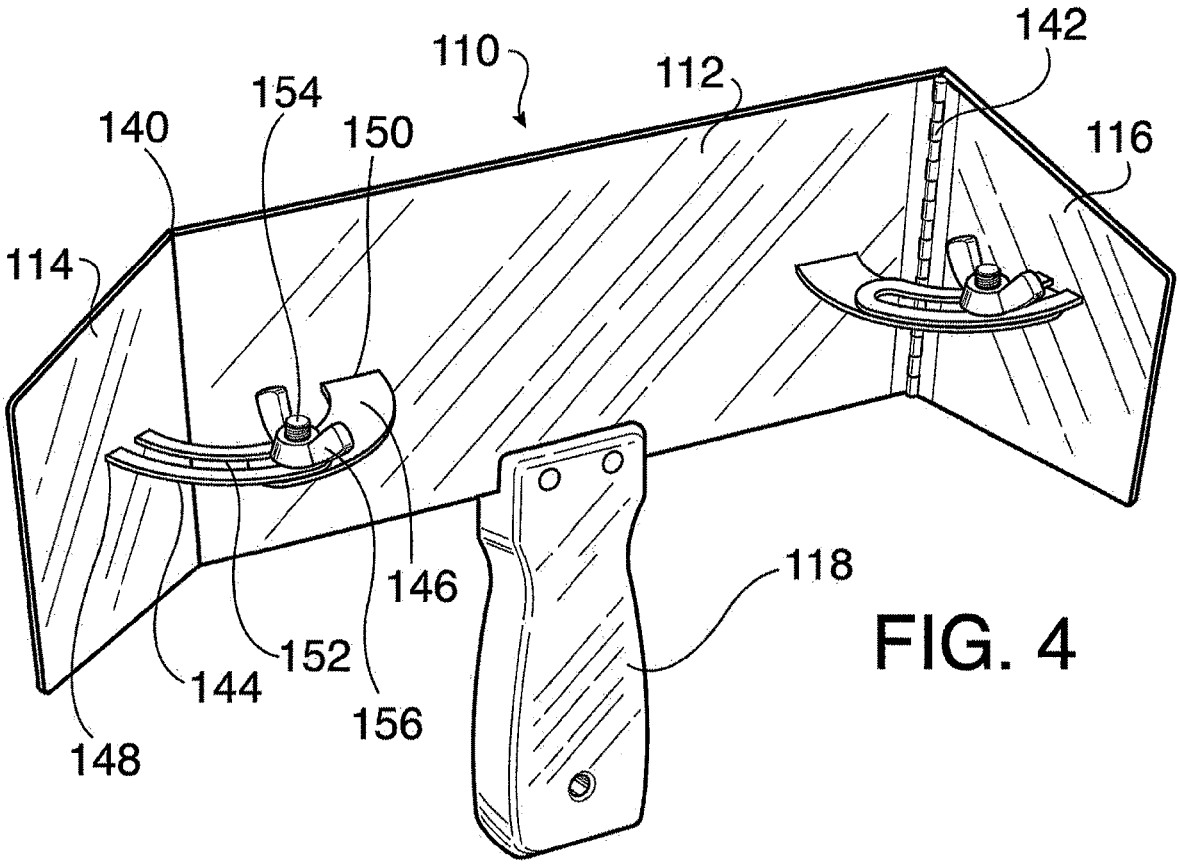
FIG. 4 is a front perspective view of a second embodiment of the three sided spackling tool of my invention.
Figure 5:
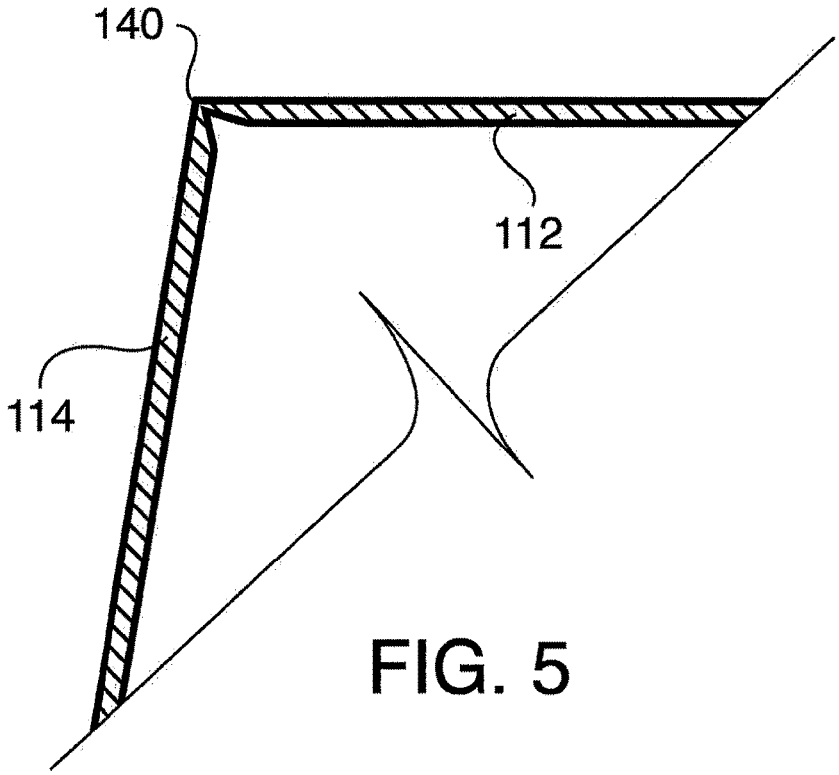
FIG. 5 is an enlarged view of the living hinge section of the tool shown at the left of FIG. 4.

FIGS. 4 and 5 illustrate a second embodiment of the invention. For ease of description and understanding, the component parts are identified with the same numbers as in the first embodiment but preceded by a 1. The spackling tool 110 similarly is comprised of four parts: a main blade 112, a left blade 114, a right blade 116 and a handle 118. Unlike the first embodiment, the left and right blades 114 and 116 are not fixed in relation to the main blade 112 but are movable so that the angle relative thereto can be changed.

While two different methods are illustrated in FIGS. 4 and 5 for making the adjustment, it is anticipated that only one of the two methods will be used in the production of a tool. That is, the same method will be used on both sides edges 120 and 122 of the main blade 112 to allow the left and right side blades 114 and 116 to be adjusted.

In the first method, the left blade 114 is connected to the main blade 112 by way of a living hinge 140 as shown in FIG. 5. A living hinge is essentially a reduced thickness area in the material that allows it to bend more easily. Living hinges are, per se, well known in the art. See, for example, U.S. Pat. No. 5,774,924.

The second method for allowing adjustability is shown at the right of FIG. 4 where right blade 116 is attached to the main blade 112 through the use of a hinge 142. While various types of mechanical hinges may be used, the type of hinge shown is preferable. Hinge 142 is commonly referred to as a piano hinge and is also well known in the art. See, for example. U.S. Pat. No. 5,467,497.

As should be readily apparent to those skilled in the art, the hinges 140 or 142 allow the left and right blades 114 and 116 to pivot relative to the main blade 112. Although most inside corners in most buildings are 90°, occasionally some are larger and some are smaller. In any event, once the angle of the side blade is adjusted to the desired position, means are provided for maintaining or locking it into the position.

In the preferred embodiment, this is accomplished through the use of arcuate arms 144 and 146 having their ends 148 and 150 secured to the left blade 114 and main blade 112, respectively. Arm 144 has an elongated curved slot 152 formed therein while the free end of arm 146 has a bolt 154 secured thereto that extends into the slot 152. When the desired angle is set, the arms are locked together by tightening the thumb nut 156. While only the left side locking arrangement has been described, it is understood that the right side is constructed in essentially the same manner. As with other specific features of the present invention, the locking arrangement is, per se, well known in the art. See, for example, variations of the same in U.S. Pat. Nos. 5,467,497 and 5,544,384.

The present invention may be embodied in other specific forms without departing from the spirit or essential attributes thereof and accordingly, reference should be made to the appended claims rather than to the foregoing specification as indicating the scope of the invention.

I claim:

1. A spackling tool for double inside corner spackling, comprising:

a main planar flat blade made of a thin resilient material, said main blade having a length with left- and right-side edges and including top and bottom edges;

a left blade extending upwardly at an angle from said left-side edge and a right blade extending upwardly at an angle from said right-side edge prior to the tool being used, a handle secured to said main blade adjacent said bottom edge and lying in substantially the same plane as said main blade, said handle being attached substantially midway between said left- and right-side edges, the left and right blades forming obtuse internal angles with the main planar flat blade, the main planar flat blade comprised of a trapezoid, where the top edge is longer than the bottom edge, the main planar flat blade having a width of at least approximately six inches.

2. The spackling tool as claimed in claim 1 wherein said left and right blades are formed by bending said material forming said main blade.

3. The spackling tool as claimed in claim 2 wherein said left and right blades extend from said main blade at an angle of about 90°.

4. The spackling tool as claimed in claim 1, wherein said left and right blades are hinged to said main blade, including means for adjusting the angle between said left and said main blade and between said right blade and said main blade.

5. The spackling tool as claimed in claim 4 including means independent of the work surface being spackled for adjusting the angle between said left and said main blade and between said right blade and said main blade and for maintaining said adjusted angles.

6. A spackling tool comprising:

a main planar flat blade comprised of sheet metal, said main blade having a length with left- and right-side edges and including top and bottom edges;

a left blade comprised of sheet metal extending upwardly at an angle from said left-side edge and a right blade comprised of sheet metal extending upwardly at an angle from said right-side edge prior to the tool being used, and a handle secured to said main blade adjacent said bottom edge and substantially midway between said left- and right-side edges the left and right blades forming obtuse internal angles with the main planar flat blade, the main planar flat blade section forming a trapezoid, where the top edge is longer than the handle-side edge of the plane, wherein the top and left or right edges are for simultaneously smoothing spackle on two perpendicular surfaces.

7. The spackling tool as claimed in claim 6 wherein said left and right blades are formed by bending said sheet metal forming said main blade.

8. The spackling tool as claimed in claim 7 wherein said left and right blades extend from said main blade at an angle of about 90°.

9. The spackling tool as claimed in claim 6 where the fontal edges of the left and right blades are angled rearward, creating an acute angle with the ceiling when the front main and front left and right blades edges are placed against with the ceiling prior to smoothing spackle.

10. The spackling tool as claimed in claim 6 where the main planar blade is approximately six to twelve inches wide, and the side blades are between about four to six inches from the main planar blade the distal edge.

* * * * *